US008010015B2

(12) United States Patent
Kadowaki

(10) Patent No.: US 8,010,015 B2
(45) Date of Patent: Aug. 30, 2011

(54) CHARGER AND IMAGE FORMING APPARATUS USING THE CHARGER

(75) Inventor: Hideaki Kadowaki, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 414 days.

(21) Appl. No.: 12/254,042

(22) Filed: Oct. 20, 2008

(65) Prior Publication Data

US 2009/0116873 A1 May 7, 2009

(30) Foreign Application Priority Data

Nov. 2, 2007 (JP) ..... 2007-285920

(51) Int. Cl.
*G03G 15/02* (2006.01)

(52) U.S. Cl. ..... 399/115; 399/171

(58) Field of Classification Search ..... 399/115, 399/170, 171, 172, 311; 250/324, 325, 326; 361/225, 229
See application file for complete search history.

(56) References Cited

U.S. PATENT DOCUMENTS

| | | | | |
|---|---|---|---|---|
| 5,079,668 | A | 1/1992 | Maeshima | 361/229 |
| 2010/0080628 | A1* | 4/2010 | Fowler | 399/171 |

FOREIGN PATENT DOCUMENTS

| | | | |
|---|---|---|---|
| JP | 02-289869 | | 11/1990 |
| JP | 04-287061 | | 10/1992 |
| JP | 05-303261 | | 11/1993 |
| JP | 09-230672 | A * | 9/1997 |
| JP | 2001-143848 | | 5/2001 |
| JP | 2003-122092 | | 4/2003 |

OTHER PUBLICATIONS

Machine translation of JP 2001-143848 A dated Feb. 3, 2011.*
Machine translation of JP 2003-122092 A dated Feb. 3, 2011.*

* cited by examiner

*Primary Examiner* — Sophia S Chen
(74) *Attorney, Agent, or Firm* — Renner, Otto, Boisselle & Sklar, LLP

(57) ABSTRACT

A grid electrode is attached to a case and a serrated electrode holder by engaging an opening of the grid electrode with a pair of engaging claws formed in the case and engaging another opening of the grid electrode with an engaging claw of the serrated electrode holder. Then, in the condition where the grid electrode has been attached to the case and serrated electrode holder, the grid electrode and the serrated electrode holder are fixed to the case by rotating them until engaging projections of the serrated electrode holder engage the engaging holes of the case.

7 Claims, 11 Drawing Sheets

CHARGER AND IMAGE FORMING APPARATUS USING THE CHARGER

This Nonprovisional application claims priority under 35 U.S.C. §119(a) on Patent Application No. 2007-285920 filed in Japan on 2 Nov. 2007, the entire contents of which are hereby incorporated by reference.

BACKGROUND OF THE INVENTION (1) Field of the Invention

The present invention relates to a charger for use in an image forming apparatus using an electrophotographic system, in particular relating to a charger having a structure that enables easy assembly as well as to an image forming apparatus including this charger.

(2) Description of the Prior Art

As is well known, an image forming apparatus using an electrophotographic system is comprised of processing portions for charging, exposure, development, transfer, separation, cleaning and charge erasure. Illustratively, for the step for recording an image, while an image bearer as a recording medium formed on a conductive support member made of, for example an aluminum drum, is rotationally driven, the image bearer surface is uniformly charged by the charger first. Then, the thus charged image bearer surface is illuminated with a light image of an original image via an optical exposure unit to record an electrostatic latent image corresponding to the light image. Subsequently, the electrostatic latent image on this image bearer is electrostatically adhered with toner for development to form a toner image on the image bearer surface.

Then, the toner image formed on the image bearer surface is transferred to a printing medium by a transfer device. The toner image transferred to the printing medium is fixed thereto by means of a heating and fixing device. The toner left over on the image bearer surface after transfer is removed by a cleaning unit and collected into a predetermined collecting portion while the residual charge on the image bearer surface after cleaning is erased by a charge erasing device in preparation for subsequent image forming.

The charger that is built in the image forming apparatus constructed as above plays an important role for uniformly charging the surface of the image bearer. However, there has been an assembly problem with the charger. Specifically, in the conventional charger, the engaging part for a discharge control electrode (grid electrode) and the part for applying tension to the grid electrode are provided separately, so that there is the problem that, that number of parts is increased and the assembly of these parts requires much time and labor. There is also a problem that it may be difficult to apply stable and desired tension so that the grid electrode will not slack when the grid electrode is assembled and disassembled.

To deal with this, the technology described in patent document 1 (Japanese Patent Application Laid-open H04-287061) discloses a mechanism to solve the above problems, in which one end of the grid electrode is fixed to one supporting member by means of a fixing member while the other end on the opposite side is engaged with an engaging member that is rotatably attached to another supporting member to thereby apply stable and desired tension to the grid electrode. This mechanism makes it possible by means of the engaging member to separate the work of attaching the grid electrode to the main shield case and the work for applying tension so as to facilitate the assembly work as well as to enable application of the necessary and stable tension.

However, even with the technology described in the above patent document 1, it was necessary to perform attachment of the discharge electrode inside the shield case and thereafter perform the attachment work of the grid electrode and the application work of tension. That is, it was impossible to shorten the working process, and the assembly needed dedicated attachment parts etc., for the grid electrode.

SUMMARY OF THE INVENTION

The present invention has been devised in view of the above circumstances, and it is therefore an object of the present invention to provide a charger which enables attachment of a grid electrode and application of tension to be done at different steps and which can suppress increase in the number of parts for attachment of the grid electrode and reduce the time for assembly work, as well as to provide an image forming apparatus using this charger.

In order to solve the above problems, the charger and the image forming apparatus according to the present invention are configured as follows:

A charger according to the present invention comprises: a discharge electrode; a discharge control electrode for controlling discharge from the discharge electrode; a discharge electrode supporter for holding the discharge electrode; and a housing for fixing the components, and is characterized in that the housing includes: a first engaging claw arranged near one end of the housing for engaging a first end of the discharge control electrode; and a pivot hole formed near the one end for pivotably supporting the discharge electrode supporter, the discharge electrode supporter includes: a pivot stud projectively formed near the one end so as to be inserted into the pivot hole; a second engaging claw for engaging a second end of the discharge control electrode on the side opposite to the first end; first and second spacing regulators for defining and setting the spacing between the discharge control electrode and the discharge electrode at a predetermined distance, and both ends of the discharge control electrode are engaged with the first and second engaging claws, then the discharge electrode supporter is rotated relative to the housing on the pivot stud so that the discharge control electrode and the discharge electrode supporter are fixed to the housing.

The charger of the present invention may be further characterized in that the discharge electrode supporter further comprises engaging projections near the end on the side where the second engaging claw is provided, and the discharge electrode supporter is arranged so as to rotate on the pivot stud relative to the housing until the engaging projections engage engaging holes formed in the housing.

Also, the charger of the present invention may be characterized in that the discharge electrode supporter has the first spacing regulator arranged at approximately the same position as that of the pivot stud and the second spacing regulator arranged at approximately the same position as that of the engaging holes with respect to the length thereof.

In the charger of the present invention the discharge control electrode may have first and second openings that engage the first and second engaging claws, respectively.

In the charger of the present invention the discharge control electrode may further have openings at the respective positions where the discharge electrode abuts the first and second spacing regulators when the discharge electrode supporter is rotated about the pivot stud and pressed against the first and second spacing regulators.

The charger of the present invention may be characterized in that the housing has one or more additional engaging claws arranged apart, at intervals of a predetermined distance, from the first engaging claw, in addition to the first engaging claw, and when the discharge control electrode is fixed to the housing, the two ends of the discharge control electrode are engaged with one engaging claw selected from the first engaging claw and the additional one or more engaging claws, and with the second engaging claw, respectively.

The charger of the present invention is further characterized in that the housing has a retainer each having an opening for receiving the pivot stud, and, when the discharge electrode supporter is attached to the housing by inserting the pivot stud into the retainer from the openings so that the discharge control electrode is fixed to the housing, the pivot stud inserted into the retainer is pressed by the stress arising from the discharge control element when it is thus fixed, in the direction toward the end at which the retainer is arranged.

Finally, the image forming apparatus according to the present invention is characterized by inclusion of any one of the above-described chargers according to the present invention.

The charger of the present invention and the image forming apparatus using this provide the excellent effects as follows.

According to the charger of the present invention and the image forming apparatus using this, since attachment of the discharge control electrode (which will be referred to hereinbelow as a grid electrode) and application of tension to it can be performed at different steps in device assembly, the attachment work of the grid electrode can be done easily. Also, since the work for applying tension to the grid electrode and the work for attaching the discharge electrode (which will be referred to hereinbelow as a serrated electrode) to housing (which will be referred to hereinbelow as a case) can be done at the same time, it is possible to reduce the working time for assembly.

Further, according to the charger of the present invention and the image forming apparatus using this, since the discharge electrode supporter (which will be referred to hereinbelow as a serrated electrode holder) is constructed as a part for imparting tension to the grid electrode, it is possible to suppress increase in the number of parts.

Moreover, even if elongation of the grid electrode has occurred, it is possible to prevent looseness of the grid electrode, hence it is possible by the tension imparted to the grid electrode to prevent the serrated electrode holder from easily coming off from the case.

DESCRIPTION OF THE PREFERRED EMBODIMENTS

Figure 1:
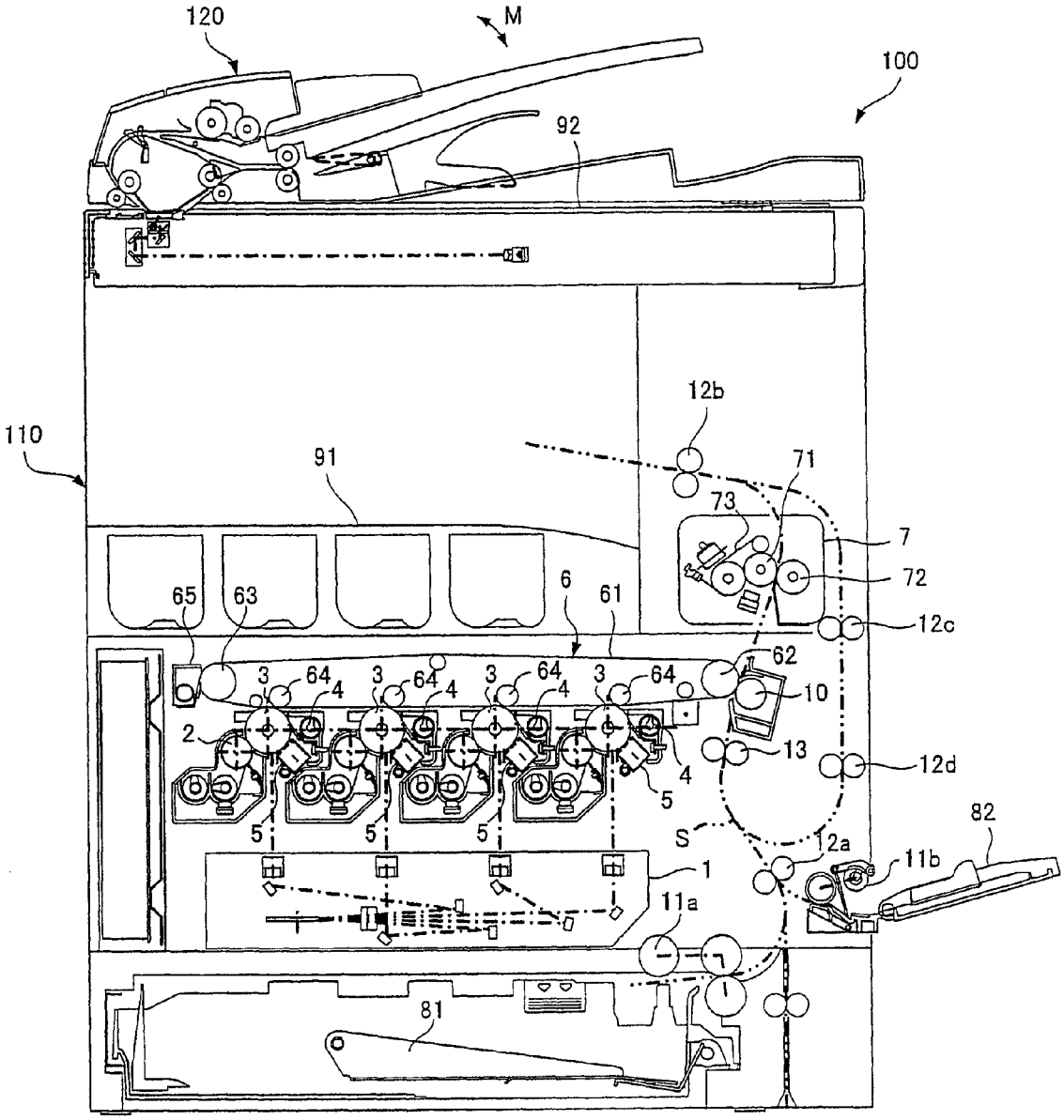
FIG. 1 is a sectional view showing a schematic configuration of an image forming apparatus including a charger according to the present invention.

The first to third embodiments of a charger according to the present invention will be described with reference to the accompanying drawings.

FIGS. 1 to 9 show one example of chargers according to the first to third embodiment of the present invention. In the drawings, the components allotted with the same reference numerals represent identical entities.

Description of the First Embodiment

Before describing the specific configuration of a charger of the present invention, the configuration and operation of an image forming apparatus using this charger will be briefly described in order to make its relationship with the charger of the present invention.

FIG. 1 is a sectional view showing a schematic configuration of an image forming apparatus 100 provided with a charger of the present invention.

Image forming apparatus 100 forms a multi-colored or monochrome image on a predetermined sheet (recording paper) in accordance with image data transmitted from an external device (e.g., image data obtained through a network). Image forming apparatus 100 is mainly composed of a main apparatus body 110 and an automatic document processor 120. The main apparatus body 110 includes: an exposure unit 1; developing units 2, photoreceptor drums 3, cleaning units 4, chargers 5, an intermediate transfer belt unit 6, a fuser unit 7, a paper feed cassette 81 and a paper output tray 91.

Arranged on top of main apparatus body 110 is a document table 92 made of a transparent glass plate on which a document is placed. On the top of document table 92, an automatic document processor 120 is mounted. Automatic document processor 120 automatically feeds documents to document table 92. This document processor 120 is constructed so as to be pivotable in the bidirectional arrow M so that a document can be manually placed by opening the top of document table 92.

The image data handled in image forming apparatus 100 is data for color images of four colors, i.e., black (K), cyan (C), magenta (M) and yellow (Y). Accordingly, four developing units 2, four photoreceptor drums 3, four chargers 5, four cleaning units 4 are provided to produce four electrostatic latent images corresponding to black, cyan, magenta and yellow. That is, four imaging stations are constructed thereby.

Charger 5 is the charger of the present invention. This charger is a charging means for uniformly charging the photoreceptor drum 3 surface at a predetermined potential and includes a serrated electrode for discharge and a discharge control electrode (which will be referred to hereinbelow as a grid electrode).

Exposure unit 1 is provided as a laser scanning unit (LSU) having a laser emitter, reflection mirrors, etc., in which a polygon mirror for scanning the laser beam, optical elements such as lenses and mirrors for leading the laser beam reflected off the polygon mirror to photoreceptor drums 3 are laid out. As exposure unit 1, other methods using an array of light emitting elements such as an EL or LED writing head, for example may be used instead.

This exposure unit 1 has the function of illuminating each of the electrified photoreceptor drums 3 with light in accordance with the input image data to form an electrostatic latent image corresponding to the image data on each photoreceptor drum surface. Developing unit 2 visualizes the electrostatic latent images formed on photoreceptor drums 3 with four color (YMCK) toners. Cleaning unit 4 removes and collects the toner left over on the photoreceptor drum 3 surface after development and image transfer.

Intermediate transfer belt unit 6 arranged over photoreceptor drums 3 is comprised of an intermediate transfer belt 61, an intermediate transfer belt drive roller 62, an intermediate transfer belt driven roller 63, four intermediate transfer rollers 64 corresponding to four YMCK colors and an intermediate transfer belt cleaning unit 65.

Intermediate transfer belt drive roller 62, intermediate transfer belt driven roller 63 and intermediate transfer rollers 64 support and tension intermediate transfer belt 61 to circulatively drive the belt. Each intermediate transfer roller 64 provides a transfer bias to transfer the toner image from photoreceptor drum 3 onto intermediate transfer belt 61.

Intermediate transfer belt 61 is arranged so as to contact with each photoreceptor drum 3. The toner images of different colors formed on photoreceptor drums 3 are sequentially transferred to intermediate transfer belt 61, forming a color toner image (multi-color toner image) on intermediate transfer belt 61. This intermediate transfer belt 61 is an endless film of about 100 μm to 150 μm thick.

Transfer of toner images from photoreceptor drums 3 to intermediate transfer belt 61 are performed by intermediate transfer rollers 64 that are in contact with the rear side of intermediate transfer belt 61. Each intermediate transfer roller 64 has a high-voltage transfer bias (high voltage of a polarity (−) opposite to the polarity (+) of the static charge on the toner) applied thereto in order to transfer the toner image. This intermediate transfer roller 64 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer belt 61. Though in the present embodiment, rollers are used as the transfer electrodes, brushes or the like can also be used instead.

The visualized electrostatic images of color toners on different photoreceptor drums 3 are laid over one after another on intermediate transfer belt 61. The thus laminated image information is transferred to the paper as intermediate transfer belt 61 and an after-mentioned transfer roller 10 that is arranged at the contact position between the paper and intermediate transfer belt 61 rotate.

In this process, intermediate transfer belt 61 and transfer roller 10 are pressed against each other forming a predetermined nip while a voltage for transferring the toner to the paper (a high voltage of a polarity (+) opposite to the polarity (−) of the static charge on the toner) is applied to transfer roller 10. Further, in order to obtain the above nip at constant, either transfer roller 10 or intermediate transfer belt drive roller 62 is formed of a hard material (metal or the like) while the other is formed of a soft material such as an elastic roller or the like (elastic rubber roller, foamed resin roller etc.).

Since the toner adhering to intermediate transfer belt 61 as the belt comes in contact with photoreceptor drums 3, or the toner which has not been transferred by transfer roller 10 from intermediate transfer belt 61 to the paper and remains thereon, would cause color contamination of toners at the next operation, the remaining toner is adapted to be removed and collected by intermediate transfer belt cleaning unit 65. Intermediate transfer belt cleaning unit 65 includes, for example a cleaning blade as a cleaning member that comes in contact with intermediate transfer belt 61. Intermediate transfer belt 61 is supported from its interior side by intermediate transfer belt driven roller 63, at the portion where this cleaning blade comes into contact with the belt.

Paper feed cassette 81 is a tray for stacking sheets (recording paper) to be used for image forming and is arranged under exposure unit 1 of main apparatus body 110. There is also a manual paper feed cassette 82 on which sheets of paper for image forming can be set. Paper output tray 91 arranged in the upper part of main apparatus body 110 is a tray on which the printed sheets are collected facedown.

Main apparatus body 110 further includes a paper feed path S that extends approximately vertically to convey the sheet from paper feed cassette 81 or manual paper feed cassette 82 to paper output tray 91 by way of transfer roller 10 and fuser unit 7. Arranged along paper feed path S from paper feed cassette 81 or manual paper feed cassette 82 to paper output tray 91 are pickup rollers 11*a* and 11*b*, a plurality of feed rollers 12*a* to 12*d*, a registration roller 13, transfer roller 10, fuser unit 7 and the like.

Feed rollers 12*a* to 12*d* are small rollers for promoting and supporting conveyance of sheets and are arranged at different positions along paper feed path S. On the other hands, pickup roller 11*a* is arranged near the end of paper feed cassette 81 so as to pick up the paper, sheet by sheet, from paper feed cassette 81 and deliver it to paper feed path S. Similarly, pickup roller 11*b* is arranged near the end of manual paper feed cassette 82 so as to pick up the paper, sheet by sheet, from manual paper feed cassette 82 and deliver it to paper feed path S.

Registration roller 13 temporarily stops the sheet that is conveyed along paper feed path S. That is, this roller has the function of delivering the sheet toward transfer roller 10 at such a timing that the front end of the paper will meet the front end of the toner image formed on intermediate transfer belt 61.

Fuser unit 7 includes a heat roller 71 and a pressure roller 72. Heat roller 71 and pressure roller 72 are arranged so as to rotate while nipping the sheet. This heater roller 71 is set at a predetermined fusing temperature by the controller in accordance with the signal from an unillustrated temperature detector, and has the function of heating and pressing the toner to the sheet in cooperation with pressure roller 72, so as to thermally fix the toner image transferred on the sheet to the sheet by fusing, mixing and pressing the color image of multiple toners. The fuser unit further includes an external heating belt 73 for heating heat roller 71 from without.

Finally, the sheet feed path will be described. As stated above, the image forming apparatus has paper feed cassette 81 for storing sheets before hand and manual paper feed cassette 82. In order to deliver sheets from these paper feed cassettes 81 and 82, pickup rollers 11*a* and 11*b* are arranged so as to lead the paper, sheet by sheet, to feed path S.

The sheet delivered from paper feed cassettes 81 or 82 is conveyed by feed rollers 12*a* on paper feed path S to registration roller 13, by which the paper is released toward transfer roller 10 at such a timing that the front end of the sheet meets the front end of the image information on intermediate transfer belt 61 so that the image information is transferred to the sheet. Thereafter, the sheet passes through fuser unit 7, whereby the unfixed toner on the sheet is fused and fixed. Then the sheet is discharged through feed rollers 12*b* onto paper output tray 91.

The paper feed path described above is that of the sheet for a one-sided printing request. In contrast, when a duplex printing request is given, the sheet with its one side printed passes through fuser unit 7 and is held at its rear end by feed roller 12*b*, then the feed roller 12*b* rotates in reverse so as to lead the sheet toward feed rollers 12*c* and 12*d*. Thereafter, the sheet passes through registration roller 13 and is printed on its rear side and discharged onto paper output tray 91.

Up to now the schematic configuration and operation of image forming apparatus 100 using chargers 5 of the present invention has been described. Next, a specific structure of charger 5 of the present invention and its operation will be described.

Figure 2:
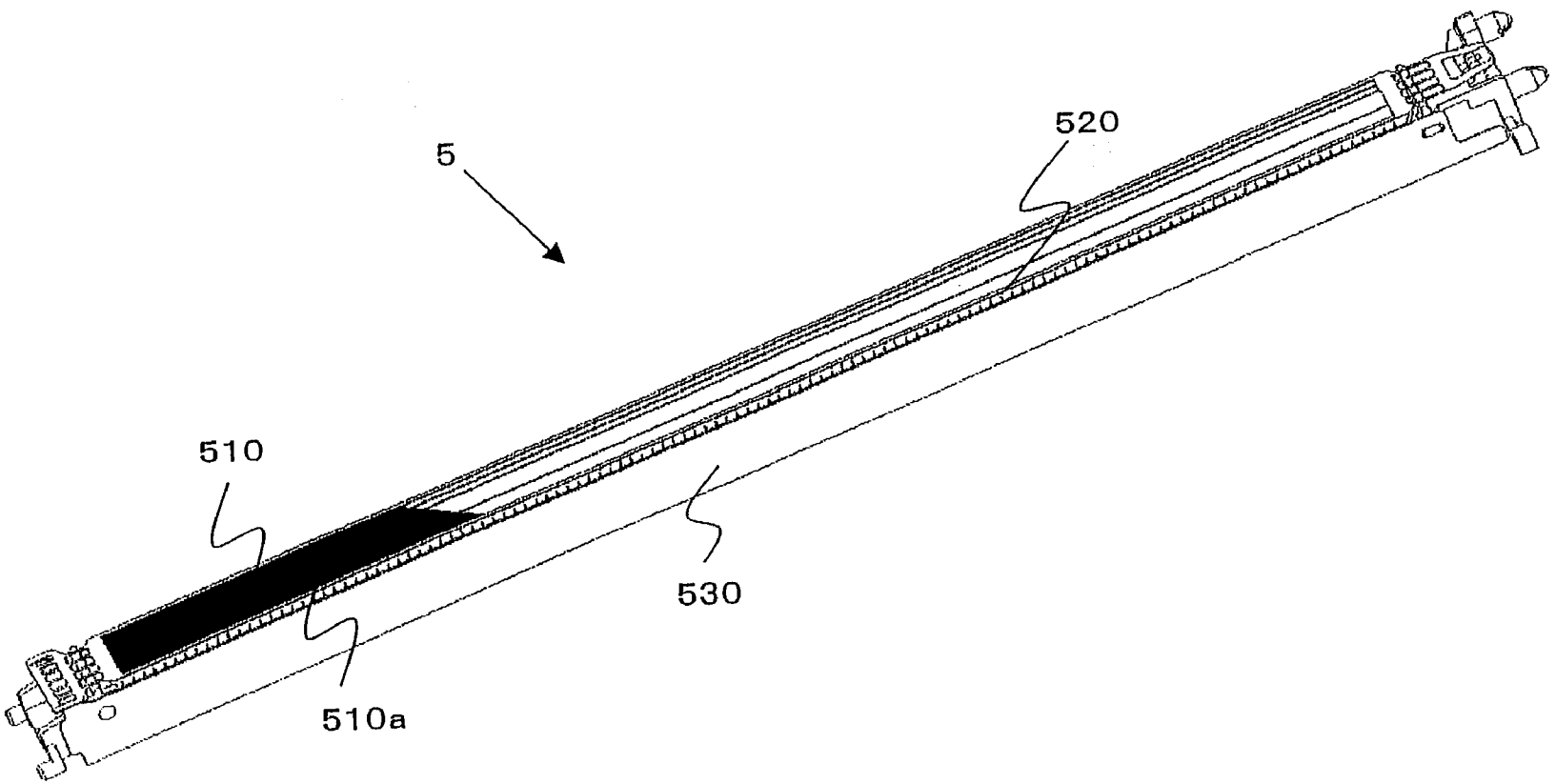
FIG. 2 is a perspective view showing a schematic configuration of a charger of the present embodiment.

FIG. 2 is a perspective view showing a schematic structure of charger 5 of the present embodiment.

Figure 3:
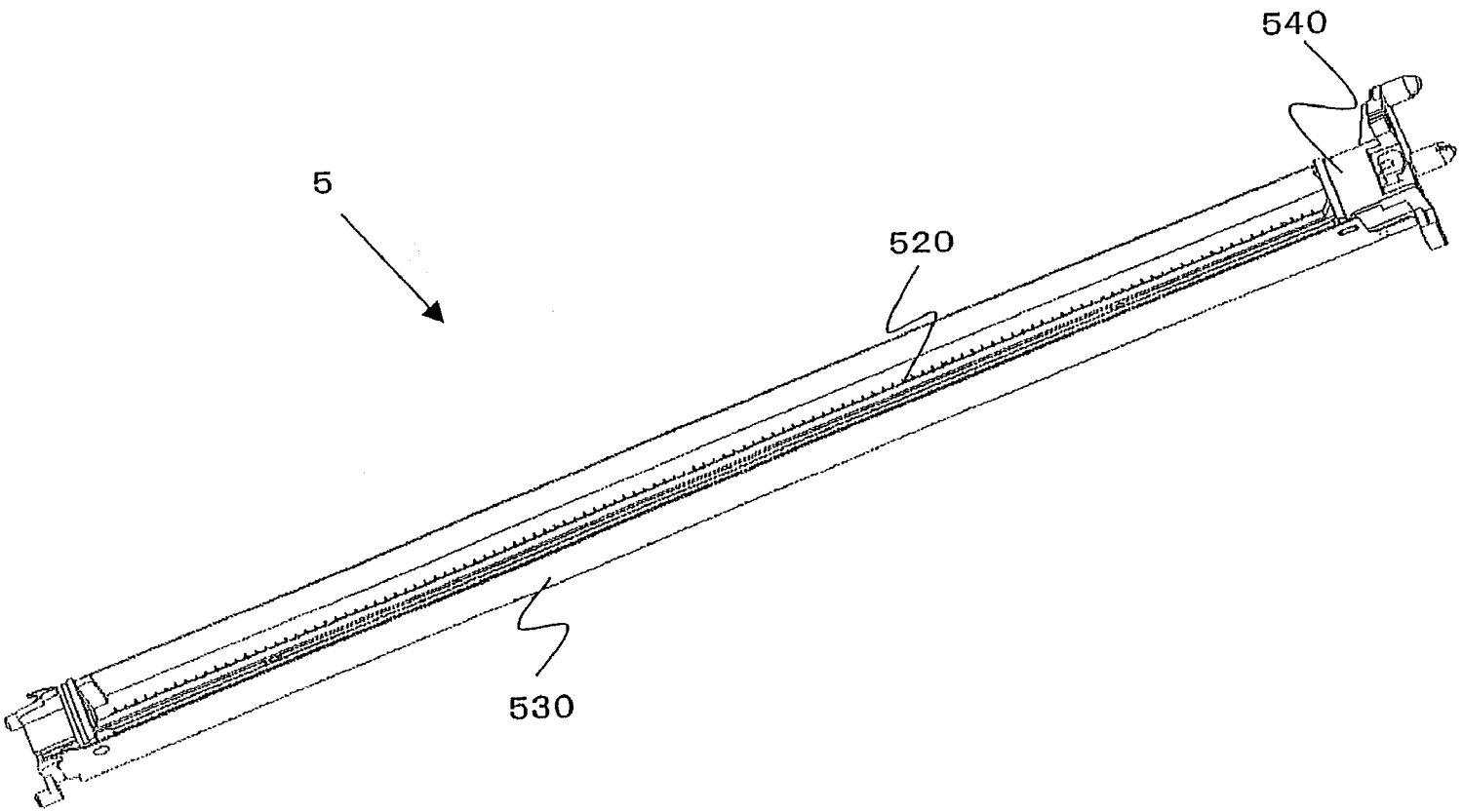
FIG. 3 is a perspective view showing a charger with its grid electrode completely detached from its case.

FIG. 3 is a perspective view showing charger 5 with its grid electrode 510 completely detached from its case 530.

As shown in FIGS. 2 and 3, charger 5 includes a grid electrode 510 attached over the top of a serrated electrode 520, a serrated electrode holder 540 for holding serrated electrode 520 and a case 530 for fixing these.

Here, serrated electrode 520 can be attached inside serrated electrode holder 540, so that the serrated electrode holder 540 as a whole can be detached from case 530.

In FIG. 2, in order to show the internal structure of case 530, grid electrode 510 is partially illustrated with grid electrode 510a only, and the other part is omitted.

Next, the attachment structure of serrated electrode holder 540 to case 530 and its attachment procedures will be described with reference to FIGS. 4 and 5.

Figure 4:
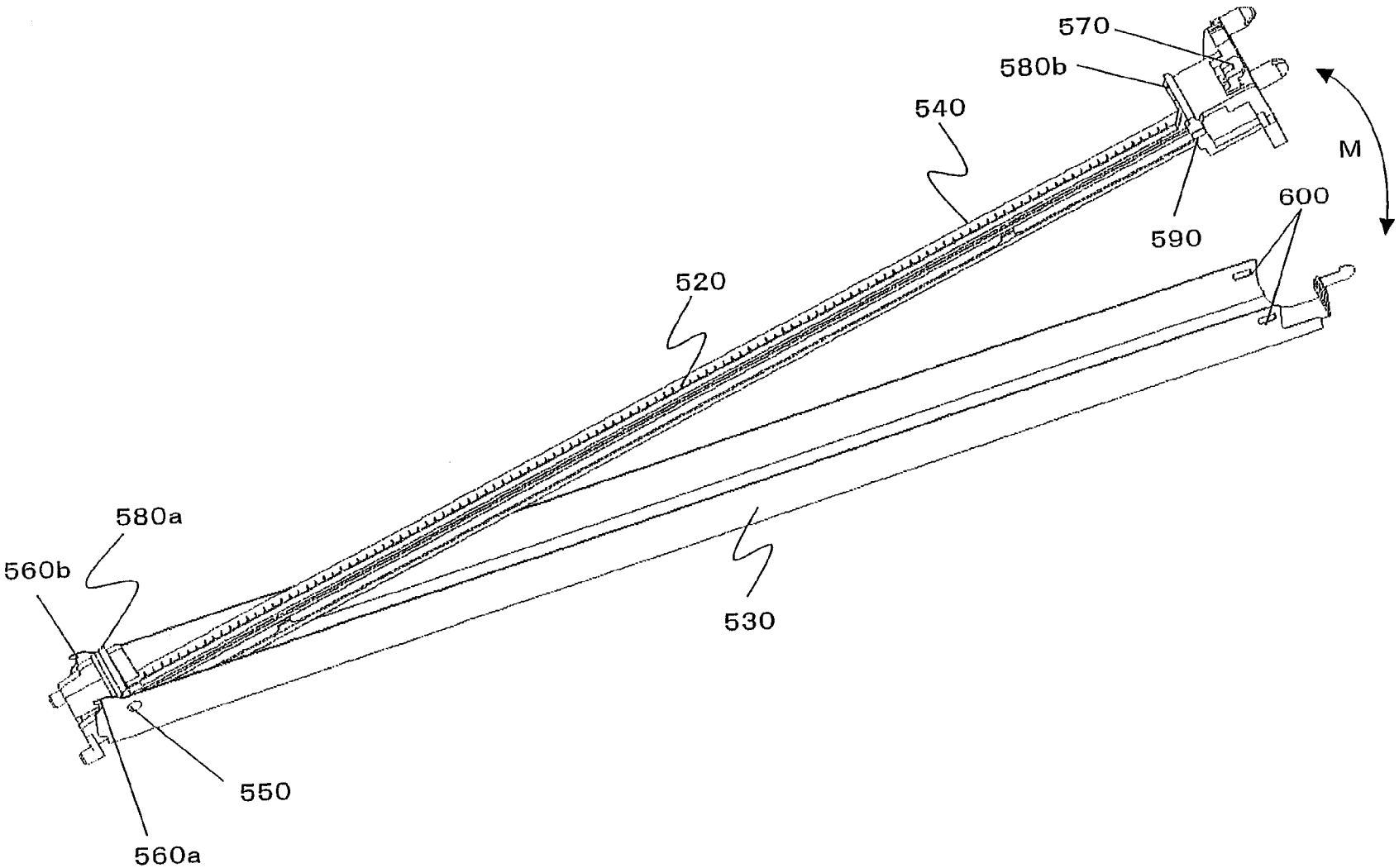
FIG. 4 is a perspective view showing a state in which a serrated electrode holder is pivoted with respect to a case.
Figure 5:
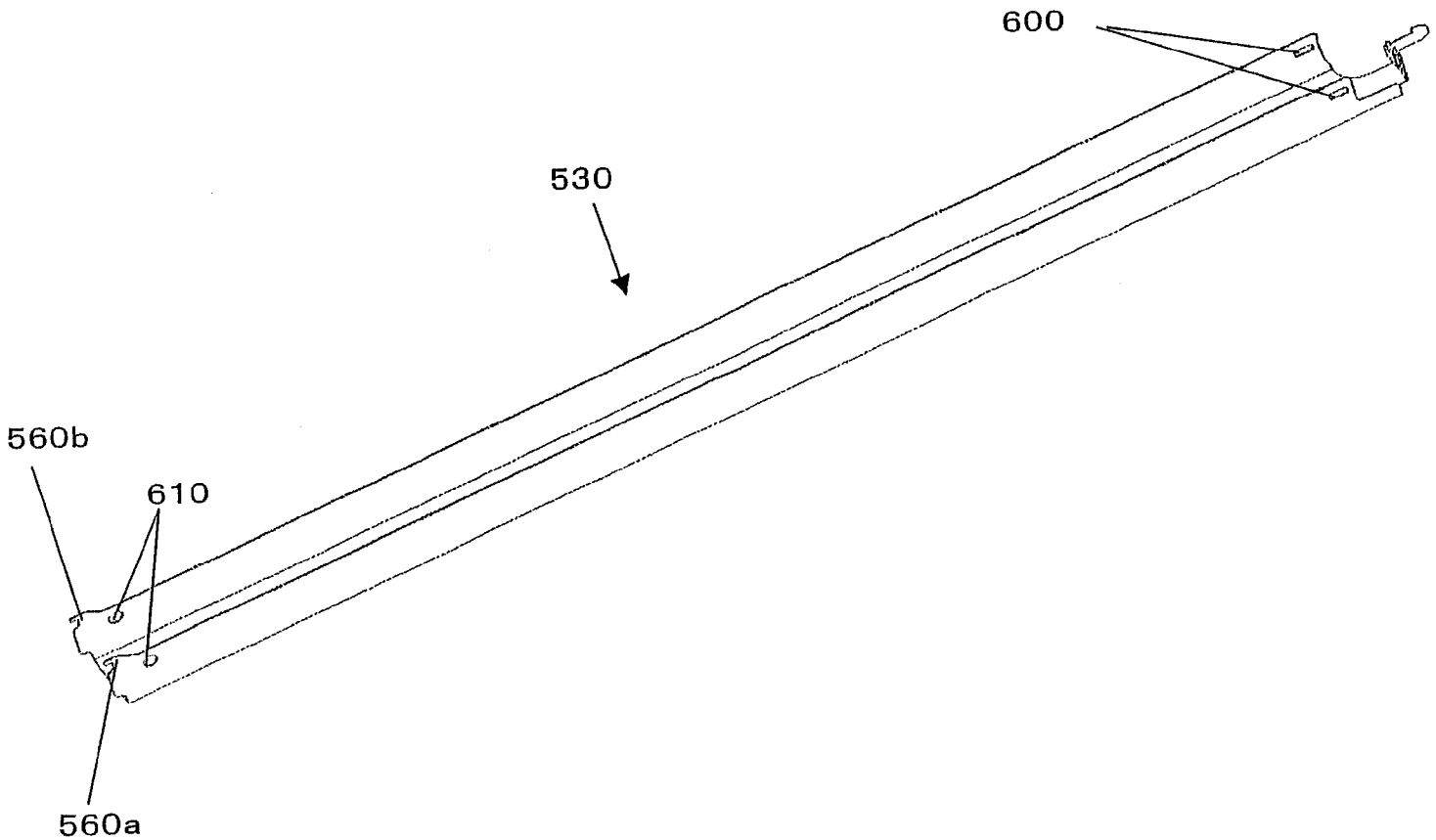
FIG. 5 is a perspective view showing a schematic configuration of a case.

FIG. 4 is a perspective view showing a state in which serrated electrode holder 540 is pivoted with respect to case 530, and FIG. 5 is a perspective view showing a schematic configuration of case 530.

As shown in FIGS. 4 and 5, case 530 has a pair of pivot holes 610 while serrated electrode holder 540 has a pair of pivot studs (of projected studs) 550 (see FIG. 7) integrally formed on both sides. This serrated electrode holder 540 is attached to case 530 by inserting pivot studs 550 into pivot holes 610. Thereby, serrated electrode holder 540 can rotate about pivot studs 550 in the bidirectional arrow M, relative to case 530.

When serrated electrode holder 540 is detached and separated from case 530, these inserted pivot studs 550 may be pulled out from pivot holes 610.

Next, the attachment structure for attaching grid electrode 510 to case 530 and serrated electrode holder 540 and how it is attached will be described with reference to FIGS. 6 to 9.

Figure 6:
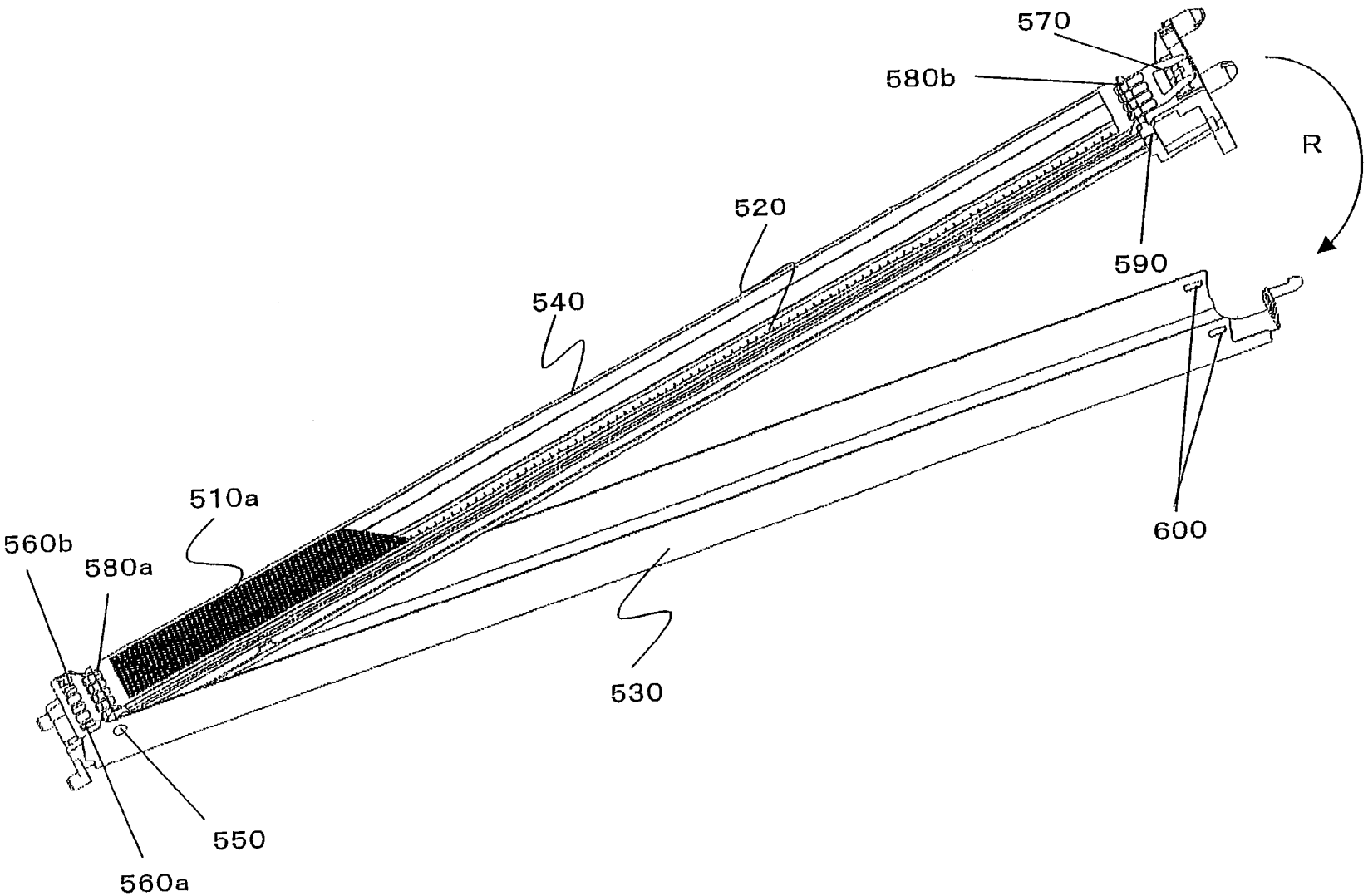
FIG. 6 is a perspective view showing a serrated electrode holder and a case with a grid electrode attached thereto in a state that the electrode holder is pivoted with respect to the case.

FIG. 6 is a perspective view showing serrated electrode holder 540 and case 530 with grid electrode 510 attached thereto in a state that electrode holder 540 is pivoted with respect to case 530.

Figure 7:
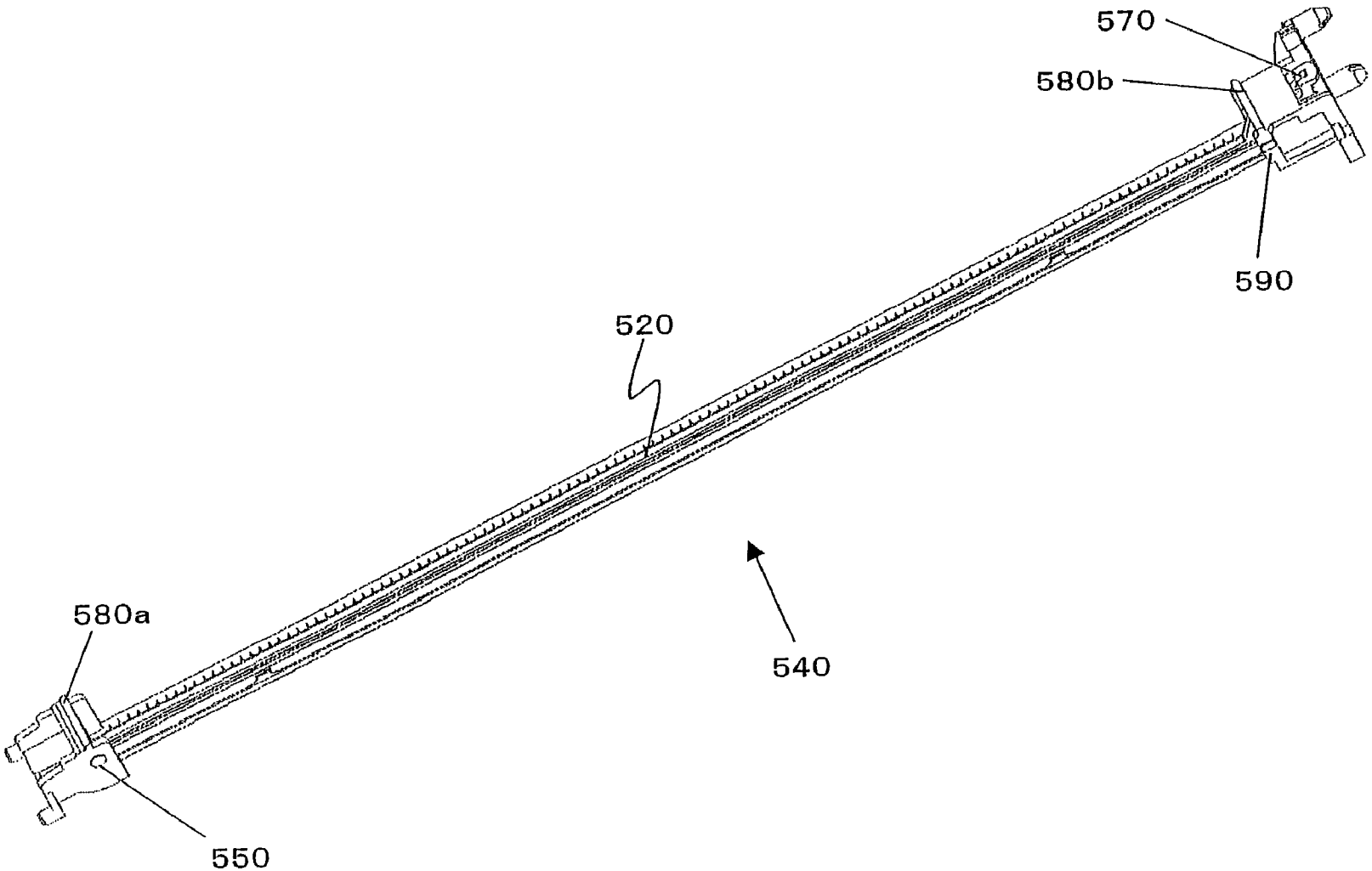
FIG. 7 is a perspective view showing a schematic configuration of a serrated electrode holder.

FIG. 7 is a perspective view showing a schematic configuration of serrated electrode holder 540.

Figure 8:
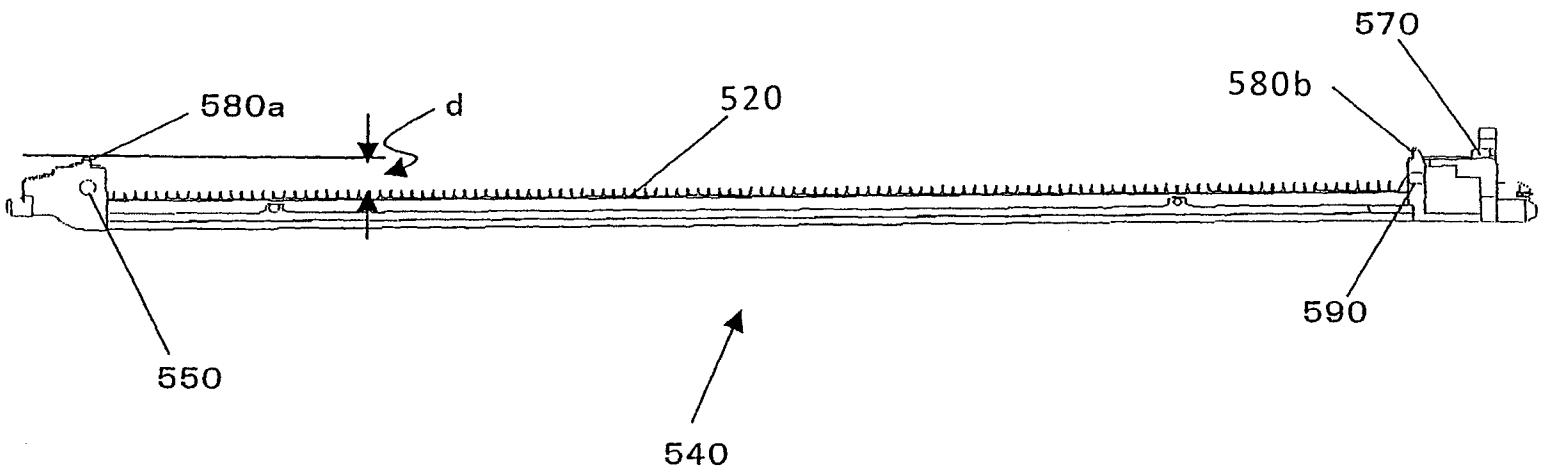
FIG. 8 is a side view showing a schematic configuration of a serrated electrode holder.

FIG. 8 is a side view showing a schematic configuration of serrated electrode holder 540.

Figure 9:
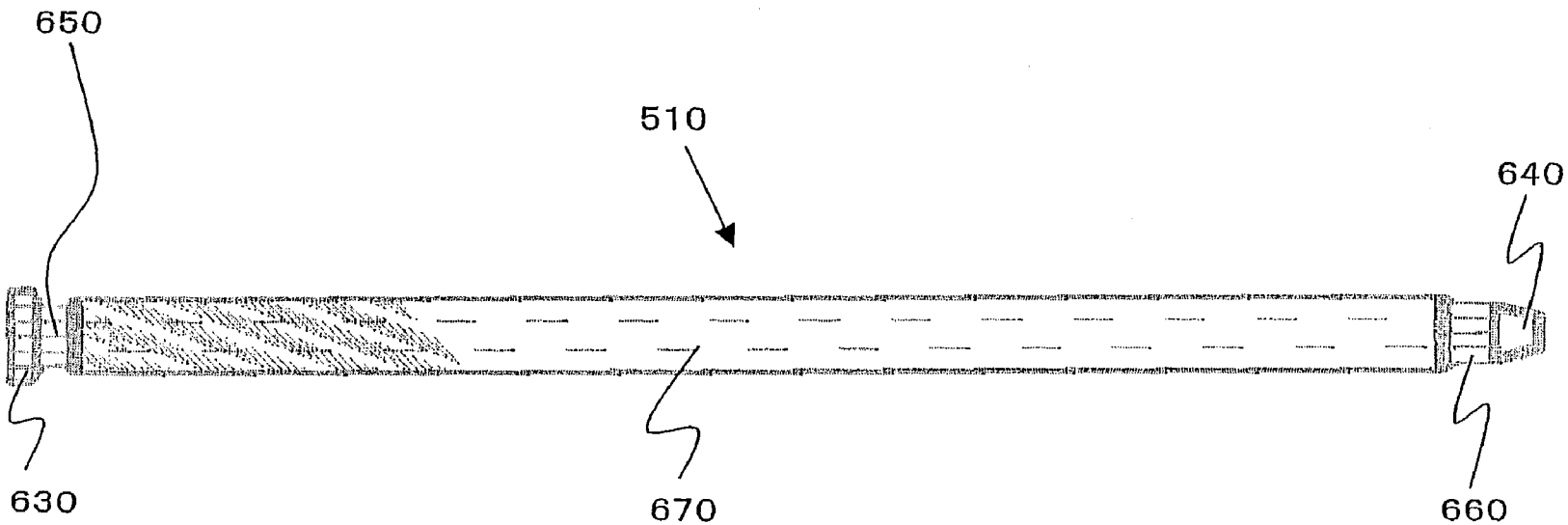
FIG. 9 is a top view showing a schematic configuration of a grid electrode.

FIG. 9 is a top view showing a schematic configuration of grid electrode 510.

Serrated electrode holder 540 shown in FIGS. 7 and 8 includes pivot studs 550, an engaging claw 570 (second engaging claw), arranged near the other holder end opposite to the holder end formed with pivot studs 550 for engagement with an opening 640 of grid electrode 510, a pair of spacing regulators 580*a* and 580*b* for defining and setting the spacing between grid electrode 510 and serrated electrode 520 at a predetermined distance d (see FIG. 8) and a pair of engaging projections 590 for engagement with engaging holes 600 (see FIG. 5) formed in case 530 in order to fix serrated electrode holder 540 to case 530.

On the other hand, grid electrode 510 is formed of, for example a thin metal sheet as shown in FIG. 9, including a grid electrode part 670 formed in a desired grating pattern by an etching or electroforming process, an opening 640 for engagement with engaging claw 570 of the aforementioned serrated electrode holder 540, an opening 630 for engagement with a pair of engaging claws 560*a* and 560*b* (first engaging claws; see FIG. 5) that are formed on the same end of case 530 where pivot holes 610 are formed, and openings 650 and 660 that abut spacing regulators 580*a* and 580*b*.

To begin with, in order to attach grid electrode 510 to charger 5, grid electrode 510 is attached to case 530 and serrated electrode holder 540 in the condition where serrated electrode holder 540 is pivoted from case 530 as shown in FIG. 6.

For this purpose, opening 630 of grid electrode 510 is engaged with the aforementioned pair of engaging claws 560*a* and 560*b* of case 530 while the opening 640 of grid electrode 510 is engaged with engaging claw 570 of serrated electrode holder 540 to thereby attach grid electrode 510 to case 530 and serrated electrode holder 540.

Then, in the condition where grid electrode 510 has been attached to case 530 and serrated electrode holder 540, grid electrode 510 and serrated electrode holder 540 are rotated in the direction of arrow R as shown in FIG. 6 until engaging projections 590 of serrated electrode holder 540 fit into engaging holes 600 of case 530, so as to be fixed to case 530.

In this way, when serrated electrode holder 530 is fixed to case 530, the assembly of charger 5 is completed and grid electrode 510 is attached to case 530.

Next, the tensioning force applied to the grid electrode when grid electrode 510 has been attached to case 530 as above will be described.

In the condition where grid electrode 510 has been attached to case 530, grid electrode part 670 is pressed upward by spacing regulators 580*a* and 580*b* arranged at both the ends of serrated electrode holder 540, opposing the positions where openings 630 and 640 arranged at both the ends of grid electrode 510 are engaged with engaging claws 560*a* and 560*b* and engaging claw 570, respectively. This pressing force regulates the distance between serrated electrode 520 and grid electrode part 670 at constant and can impart a predetermined stable tension to grid electrode part 670.

Further, since spacing regulators 580*a* and 580*b* are arranged in approximately the same geometry with respect to the length direction relative to pivot 550 and engaging projections 590, respectively, it is possible for case 530 to receive the repulsive forces from grid electrode 510 when grid electrode part 670 is pressed by spacing regulators 580*a* and 580*b*. As a result, it is possible to prevent serrated electrode holder 540 from being deformed by the repulsive forces.

Here, provision of openings 650 and 660 for grid electrode 510 in the areas that abut spacing regulators 580*a* and 580*b* weakens the rigidity of grid electrode 510 and makes the grid electrode part 670 straight with respect to the photoreceptor drum 3 surface when grid electrode 510 is pressed by spacing regulators 580*a* and 580*b*, thereby enabling the grid electrode to fully exhibit its control performance.

Description of the Second Embodiment

As shown in FIG. 5, case 530 of charger 5 of the above first embodiment has a pair of engaging claws 560*a* and 560*b*. These engaging claws 560*a* and 560*b* engage opening 630 of grid electrode 510 and are positioned at the predetermined position of case 530 so as to provide constant stable tension to grid electrode 510 when grid electrode 510 is fixed to case 530, as described above.

However, there are cases in which grid electrode 510 becomes "loose" from reasons such as grid electrode 510 being elongated, so that it cannot produce the desired tension any longer. To deal with such a situation, in the present embodiment, multiple pairs of engaging claws are formed in case 530 a predetermined distance apart from one another so as to selectively absorb the aforementioned looseness.

Figure 10:
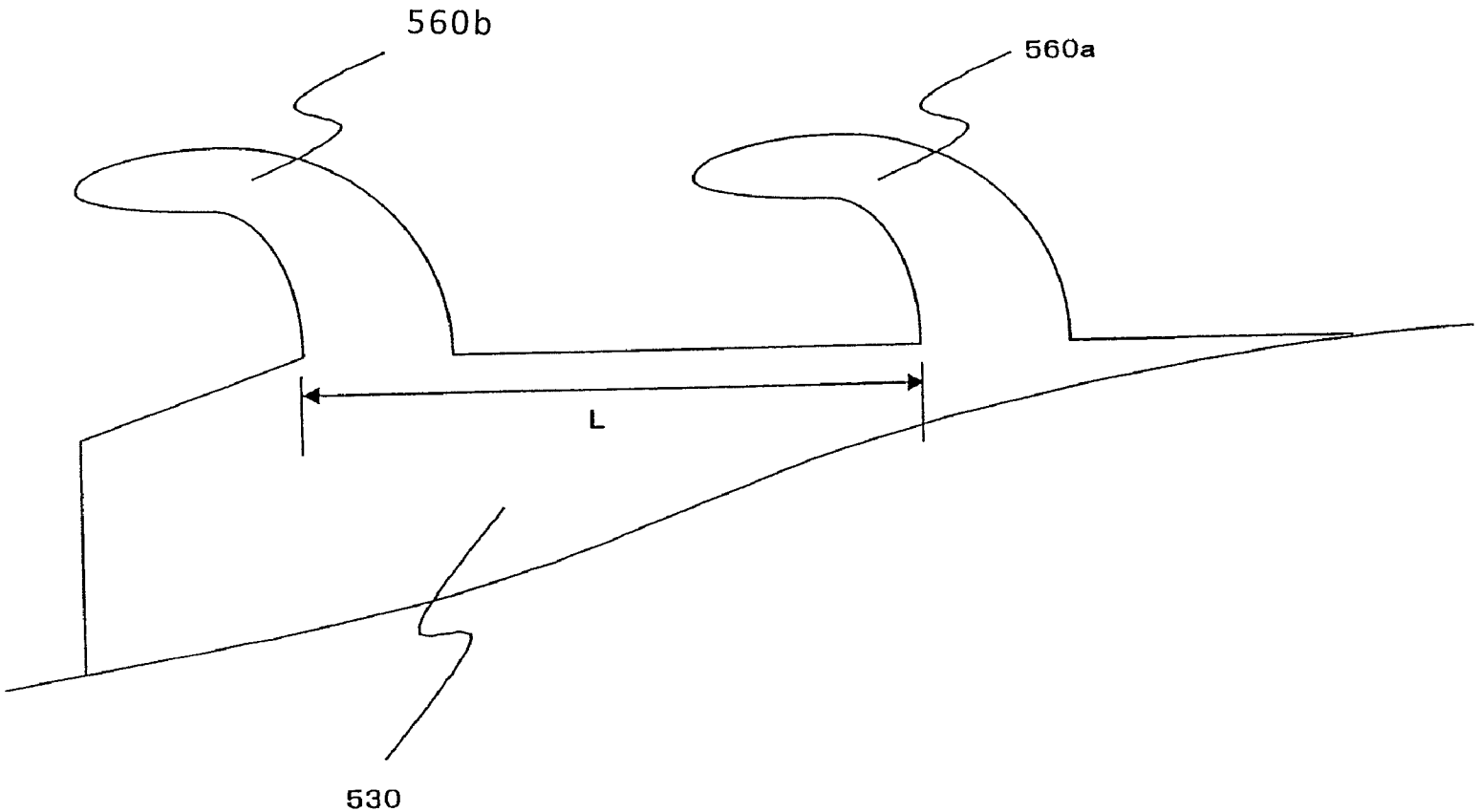
FIG. 10 is an enlarged view showing an arrangement of two pairs of engaging claws that engage an opening of a grid electrode.

FIG. 10 is an enlarged view showing an arrangement of two pairs of engaging claws that engage the opening of the grid electrode.

As shown in FIG. 10, case 530 has a pair of engaging claws 560*a* and 560*b* formed a predetermined distance L apart from a pair of engaging claws 560*a* and 560*b*. When grid electrode 510 has a length falling within the predetermined permissible range, engaging claws 560*a* and 560*b* are selected so as to engage opening 630 of grid electrode 510. When grid electrode 510 has a length exceeding the predetermined permissible range, engaging claws 560*a* and 560*b* are selected so as to engage opening 630 of grid electrode 510.

In this way, selection of a suitable pair of engaging claws that engage the opening of grid electrode 510 in accordance with the elongation of the length of grid electrode 510, makes it possible to eliminate "looseness" that would occur when grid electrode 510 is fixed to case 530 and to impart the necessary tension to grid electrode 510.

Description of the Third Embodiment

Next, a charger 5 according to the third embodiment of the present invention will be described.

The charger 5 of the above first embodiment has an attachment structure of serrated electrode holder 540 to case 530 by inserting pivot 550 of serrated electrode holder 540 into pivot holes 610 of case 530 so as to support pivot 550 on pivot holes 610. However, in the present embodiment, instead of using pivot holes 610, a structure using different retainers for supporting pivot 550 is used.

Figure 11A:
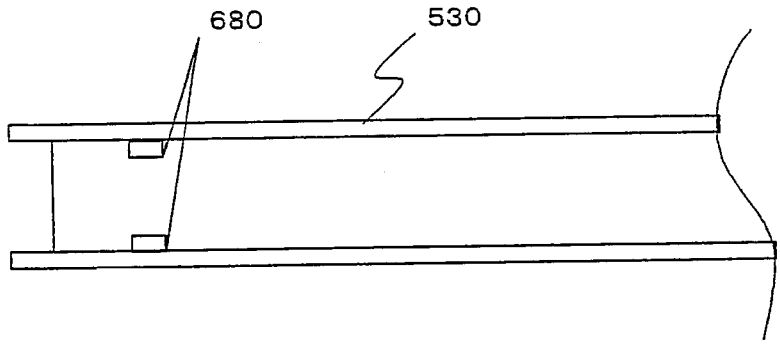
FIG. 11A is a view showing an arrangement and schematic configuration of retainers in a charger case according to the third embodiment of the present invention when the charger case is viewed from top or in the grid electrode attachment direction.
Figure 11B:
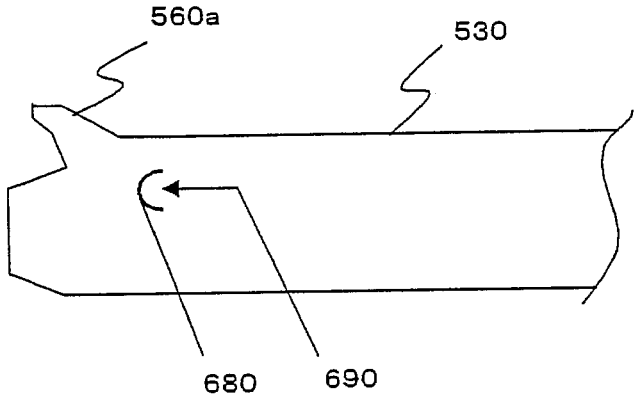
FIG. 11B is a view showing an arrangement and schematic configuration of retainers in a charger case according to the third embodiment of the present invention when the charger case is viewed from side; and, FIG. 11C is a view of an arrangement and schematic configuration of retainers in a charger case according to the third embodiment of the present invention, showing how the pivot is held on the retainers of the charger case.
Figure 11C:
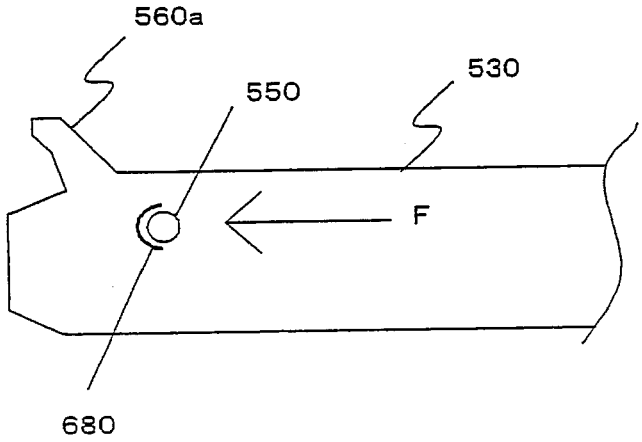

FIGS. 11A, 11B and 11C are views showing an arrangement and schematic structure of retainers in the charger case according to the third embodiment of the present invention. FIG. 11A is a top view showing the charger case in the grid electrode attachment direction; FIG. 11B is a side view showing the charger case from its side; and FIG. 11C shows how the pivot is held on the retainers of the charger case.

As shown in FIG. 11A, retainers 680 that support pivot 550 are each a projected piece projected inwards in case 530. Each of these projected pieces is formed with an opening 690 on the side opposite from the position where engaging claw 560*a* is arranged, as shown in FIG. 11B, so as to enable pivot 550 to be inserted through these openings 690. As shown in the drawings, retainer 680 has a cylindrical shape having a cutout (opening 690).

In order to fix pivot 550 of serrated electrode holder 540 to the retainers 680 thus constructed, pivot 550 is inserted from openings 690 first. Then, after openings 630 and 640 of grid electrode 510 are engaged with engaging claws 560*a*, 560*b* and 570, the serrated electrode holder is rotated about pivot 550 so as to attach grid electrode 510 to case 530, whereby pivot 550 of serrated electrode holder 540 is securely fixed to retainers 680.

In this condition, the stress from grid electrode 510 acts on pivot 550 in the direction of arrow F (to the end on the side where engaging claw 560*a* is located), hence pivot 550 is pressed against retainers 680 so that the serrated electrode holder 540 will not easily come off from openings 690.

In the above way, since the retainers 680 function as insert guides for pivot 550, the attachment work of serrated electrode holder 540 to case 530 can be made easier than the case when pivot 550 is inserted into pivot holes 610 as in the first embodiment. Accordingly, it is possible to prevent serrated electrode holder 540 from easily coming off from case 530 through opening 690.

As has been described heretofore, since serrated electrode holder 540 is constructed so as to be able to impart tension to grid electrode 510, it is possible to suppress increase in the number of parts. Also, since the work for applying tension and the work for attaching serrated electrode 540 having serrated electrode 520 built therein to case 530 can be done at the same time, it is possible to reduce the working time.

The charger of the present invention and the image forming apparatus including this charger should not be limited to the above-described embodiments, but various changes can, of course, be made therein without departing from the sprit and scope of the invention.

What is claimed is:

1. A charger comprising:

a discharge electrode;

a discharge control electrode for controlling discharge from the discharge electrode;

a discharge electrode supporter for holding the discharge electrode; and a housing for fixing the discharge electrode, the discharge control electrode, and the discharge electrode supporter, wherein the housing includes:

a first engaging claw arranged near one end of the housing for engaging a first end of the discharge control electrode; and a pair of retainers disposed opposite to each other and formed near the one end for pivotably supporting the discharge electrode supporter, the discharge electrode supporter includes:

a pivot stud projectively formed near the one end so as to be inserted into the retainers;

a second engaging claw for engaging a second end of the discharge control electrode on the side opposite to the first end;

first and second spacing regulators for defining and setting the spacing between the discharge control electrode and the discharge electrode at a predetermined distance, and wherein the pair of retainers each includes a cutout projected inwards in the housing and formed in semi-cylindrical shape which enables the pivot stud to be inserted therethrough, when the discharge electrode supporter is attached to the housing by inserting the pivot stud into the cutout of each of the retainers so that the discharge control electrode is fixed to the housing, the pivot stud inserted into the retainers is pressed by the stress arising from the discharge control electrode when the discharge control electrode is thus fixed, in the direction toward the end at which the retainers are arranged, and both ends of the discharge control electrode are engaged with the first and second engaging claws, then the discharge electrode supporter is rotated relative to the housing on the pivot stud so that the discharge control electrode and the discharge electrode supporter are fixed to the housing.

2. The charger according to claim 1, wherein the discharge electrode supporter further comprises engaging projections near the end on the side where the second engaging claw is provided, and the discharge electrode supporter is arranged so as to rotate on the pivot stud relative to the housing until the engaging projections engage engaging holes formed in the housing.

3. The charger according to claim 2, wherein the discharge electrode supporter has the first spacing regulator arranged at approximately the same position as that of the pivot stud and the second spacing regulator arranged at approximately the same position as that of the engaging holes with respect to a length thereof.

4. The charger according to claim 1, wherein the discharge control electrode has first and second openings that engage the first and second engaging claws, respectively.

5. The charger according to claim 1, wherein the discharge control electrode further has openings at the respective positions where the discharge electrode abuts the first and second spacing regulators when the discharge electrode supporter is rotated about the pivot stud and pressed against the first and second spacing regulators.

6. The charger according to claim 1, wherein the housing has one or more additional engaging claws arranged apart, at intervals of a predetermined distance, from the first engaging claw, in addition to the first engaging claw, and when the discharge control electrode is fixed to the housing, the two ends of the discharge control electrode are engaged with one engaging claw selected from the first engaging claw and the additional one or more engaging claws, and with the second engaging claw, respectively.

7. An image forming apparatus including a charger according to claim 1.

* * * * *